US005348526A

United States Patent [19]

Feygin

[11] Patent Number: 5,348,526

[45] Date of Patent: Sep. 20, 1994

[54] HAND HELD PAPER SHEET FOLDING DEVICE

[76] Inventor: Ilya Feygin, 853 Hillside Ave., Mountainside, N.J. 07092

[21] Appl. No.: 111,549

[22] Filed: Aug. 25, 1993

[51] Int. Cl.[5] ..... B65H 45/20

[52] U.S. Cl. ..... 493/405; 493/451; 493/458

[58] Field of Search ..... 493/395, 405, 451, 458

[56] References Cited

U.S. PATENT DOCUMENTS

| | | | |
|---|---|---|---|
| 514,013 | 2/1894 | Litchfield | 493/405 |
| 702,085 | 6/1902 | Barnes | 493/405 |
| 797,864 | 8/1905 | Naylor . | |
| 3,092,379 | 6/1963 | Collier . | |
| 4,421,500 | 12/1983 | Smith | 493/405 |
| 5,226,876 | 7/1993 | Watson | 493/457 |
| 5,259,827 | 11/1993 | Staniszewski | 493/451 |

FOREIGN PATENT DOCUMENTS 724212 8/1942 Fed. Rep. of Germany .

*Primary Examiner*—Jack Lavinder

[57] ABSTRACT

A hand held, manually operated paper folding device, made out of thin, high density material, divided into four sections by specially introduced flexible joints. Three of the sections are similar and together equal the size of a standard paper sheet which is placed on top of these sections prior to the folding process. The fourth section is about ⅛" narrower, which allows it to be folded on top of the adjacent third section, providing means to accommodate, align and hold paper sheets between the third and the forth sections, while also permitting the following folding of all three equal sections in a zig zag fashion, generating within one motion, buckling, formation of two sharp creases and the uniform triple folding of all inserted paper sheets. The inherent springiness of the folded paper sheets and the paper sheet folding device itself assures the release of all paper sheets after the completion of the folding process and release of the paper sheet folding device.

4 Claims, 2 Drawing Sheets

HAND HELD PAPER SHEET FOLDING DEVICE

FIELD OF INVENTION

This invention relates to the group of personal office devices which facilitate the document and paper sheet folding process which is required in order to insert said documents or paper sheets into the standard size envelope.

BACKGROUND OF THE INVENTION

A variety of automatic, semi-automatic and manually operated mechanisms have been introduced to simplify, accelerate and standardize the process of paper sheets and document folding, thereby expediting their insertion into envelopes.

The most popular triple folding method, if performed manually, requires substantial skill or time and is tiring and unkempt when large volumes of mail have to be handled.

Heretofore two main types of paper sheets folding mechanisms have been evaluated.

Automatic paper sheets folding mechanisms with a complex feeding, holding and buckling actions are described in various sources and patents. The most typical representation of these mechanisms is offered in U.S. Pat. No. 5,000,432 by Marek Krasuski, et al. or U.S. Pat. No. 5,114,395, by Richard J. Abramson. These devices are developed in order to handle large volumes of identical sheets of mail and have restrictions as to the number of sheets in the stack as well as their orientation and alignment. They can be described as complex, power driven mechanisms with multiple rollers and an elaborate sequence of motions, providing a fast folding process for the properly inserted sheets of paper. Both price and maintenance of automatic folding mechanisms can be prohibitive either for private or business office use.

Suggested manual folding mechanisms are rare, bulky, inefficient and too expensive to justify either their widespread production or utilization. One of the manually operated folding guides, described in U.S. Pat. No. 4,421,500 by Samuel C. Smith, consists of a table top horizontal surface with two side flaps, which, when folded sequentially on top of the main horizontal surface, generates two creases on the paper sheet, located on top of the device. This unit requires careful orientation, positioning and insertion of the paper under the specially provided side holding tabs before the start of the folding process. The device is complex in use and in production, equipped with additional resilient flap opening elements, occupies substantial working space and requires a sequence of multiple operations, including the insertion of paper sheets, location of said paper under special guides or retainers, closing and opening of said flaps, as well as the following steps of removal of the creased but unfolded document.

It would be highly desirable, therefore, to have a manually operated, hand held paper folding device, which will have no mechanical or electrical components, will assure the aligning and uniform triple folding of multiple sheets of paper in one motion, will assure easy insertion and extraction of those sheets in folded condition, will be light, user friendly, affordable and portable.

SUMMARY OF THE INVENTION

Accordingly, an object of the present invention is to provide a hand held, manually operated, inexpensive paper folding device which will assure fast and uniform triple folding of single or multiple paper sheets, which are to be inserted into a particular size envelope.

Another object of the present invention is to provide a hand held paper folding device, made of at least one rectangular thin sheet of high density material made of at least four rectangular sections connected along their elongated sides, whereby three adjacent folding sections are of equal size and the fourth holding section being $\frac{1}{8}''$ narrower then said adjacent third folding section.

Another object of the present invention is to provide flexible joining means between the four sections, enabling the described device to be folded in four, with the fourth holding section, when bend towards the other three folding sections, becoming simultaneously an aligning limit and a bottom holder for single or multiple sheets of paper, placed on top of the other three folding sections.

Another object of the present invention is to provide joining means formed in such a fashion, that after the fourth holding section is being bend and pressed against the adjacent third folding section, said joining means will allow all three folding sections to be further folded in a zig zag pattern, therefore providing means to align, buckle, form two creases and uniformly triple fold the paper sheets.

Another object of the present invention is to provide access notches on top or bottom of every folding section to assist in the easy removal of the folded paper sheets from the inside of the released paper folding device after completion of the folding action.

Another object of the present invention is to provide an additional holding flap attached to the top of first folding section, providing means of holding the top portion of the document while conducting the folding process, therefore minimizing handling of documents sensitive to excessive touching.

A still further object of the present invention is to provide a folding device, which can fit into the envelope together with the folded sheets to serve as a protective cover during the shipment for the paperwork and documents sensitive to any mechanical impact or bending.

A still further object of the present invention is to supply a disposable folding device, which can itself serve as a rigid mailing envelope, mailing card, record keeping surface, information bulletin or new advertising media.

A still further object of the present invention is to provide a simple tool, which will enable handicapped people and people with any type of coordination disorder to accomplish the alignment and folding of paperwork.

Among the advantages of the suggested device are simplicity and reliability of operation, low production cost, portability and light weight, as well its inherent ability to serve as media for any printed or hand written information.

Advantages of this previously unavailable paper folding device will be further illustrated from the following description and accompanying drawings.

DRAWING REFERENCE NUMERALS

Figure 1:
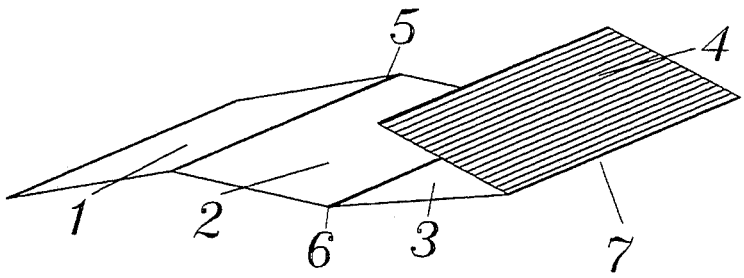
FIG. 1 Illustrates the paper folding device in unfolded position.

1. First folding section
2. Second folding section
3. Third folding section
4. Bottom holding section
5. Flexible joint between first and second folding sections
6. Flexible joint between second and third folding sections
7. Flexible joint between third folding section and fourth holding section
10. Inserted paper sheets
12. Access notch
14. Top holding flap
15. Flexible joint between top holding flap and first folding section

DETAILED DESCRIPTION

FIG. 1 illustrates the overall view of the manually operated paper sheet folding device according to the preferred embodiment of the invention, shown in the unfolded and unstressed position. The device comprises a rectangular sheet of thin, high density material divided into four sections 1, 2, 3 and 4 by flexible joints 5, 6 and 7. The first three folding sections 1, 2 and 3 are equal in width and length, while the forth holding section 4, which serves as a holder for the bottom part of the document, is made approximately ⅛" shorter than three folding sections. Flexible joint 5 between folding sections 1 and 2 allows bending in the direction opposite to the bending direction of flexible joint 6 formed between folding sections 2 and 3 in order to stimulate a zig zag collapsing pattern, while the flexible joint 7, formed between the folding section 3 and holding section 4, allows the latter to be folded on top of said folding section 3.

Figure 2:
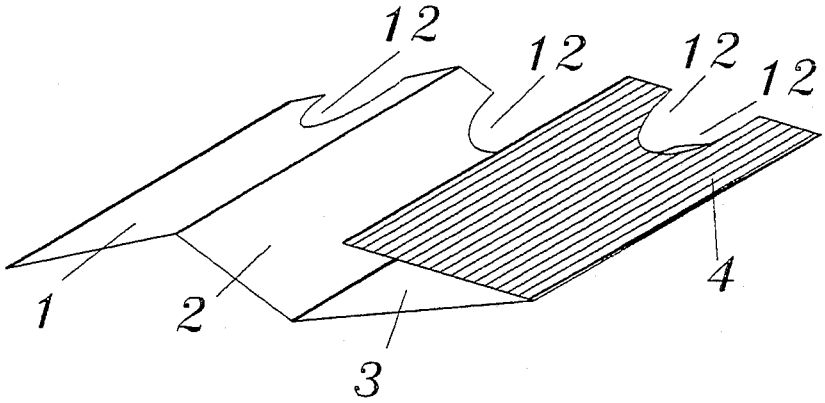
FIG. 2 Illustrates the paper folding device equipped with access notches for document extraction.

FIG. 2 illustrates a folder equipped with access notches 12 introduced in the top portion of all four sections of the folder in order to simplify the gripping of the folded document and its removal from the paper folding device.

Figure 3:
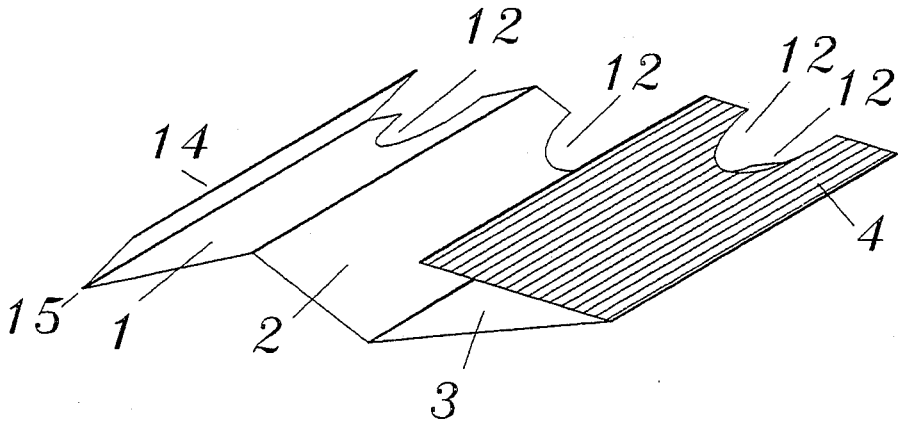
FIG. 3 Illustrates the paper folding device equipped with an additional top holding flap.

FIG. 3 illustrates a paper folding device equipped with a top holding flap 14 attached to the first folding section 1 by means of flexible joint 15. Top holding flap serves as a holder for the top portion of the document and minimizes touching of the document during the folding action.

Figure 4:
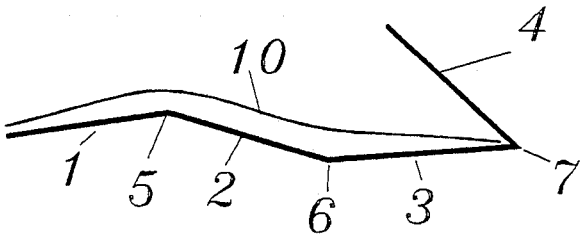
FIG. 4 Illustrates the side view of the open paper folding device with paper sheets placed on top.

FIG. 4 illustrates the side view of the paper folding device with single or multiple sheets of paper 10 located on top of three folding sections 1, 2 and 3 and referenced against the inside of the flexible joint 7.

Figure 5:
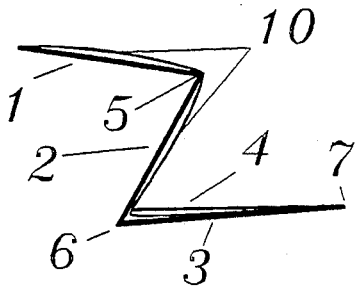
FIG. 5 Illustrates the side view of the paper folding device with closed bottom holding section and beginning of the folding motion.

FIG. 5 illustrates the paper folding device in a semi folded zig zag pattern position with the bottom holding section 4 pressed against the third folding section 3.

Figure 6:
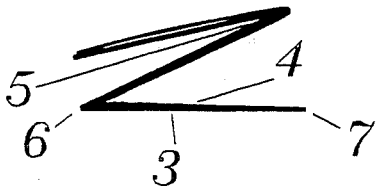
FIG. 6 Illustrates the side view of the paper folding device with almost completed folding motion.

FIG. 6 illustrates the paper folding device in almost fully closed position, which is also descriptive of the position assumed by said device when it is being released after the completion of the folding process.

Material of the folder should be sufficiently thin, rigid and of lower friction in order to assure ease of operation and removal of the folded sheets of paper. Such materials as cardboard paper, plastic or light metal sheets could be used to manufacture the paper folding device.

DESCRIPTION OF OPERATION

The proposed paper folding device assures fast and accurate triple folding of paper documents prior to their insertion into the mailing envelope.

Single or multiple paper sheets can be easily aligned with their long side against the long side of the folder with the following alignment of their bottom edge against the flexible joint 7 of the holding section 4. Closing of the holding section 4 and pressing it against the folding section 3 provides not only the aligning and holding action, but also generates the first bend in the inserted document. Said bend is formed into a sharp crease by the following squeezing of the document between the second folding section 2 against the bottom holding section 4. Top portion of the folded document can be easily bent around the flexible joint 5 and aligned and pressed against the first folding section 1, creating in the process the second sharp crease of the inserted paper sheets 10 therefore completing the triple folding action.

Additional top holding flap 14 can be used to hold the top portion of the inserted document and minimize direct finger contact with the document.

After the folding action has been completed and reinforced, if necessary, by squeezing of the entire package, the paper folding device should be released, and the natural springiness of the folded material partially opens the paper folding device to a degree which permits the easy extraction of the document sideways. This action can be further simplified by introducing the access notches 12, in which case it becomes much easier to grab the entire stack of papers and remove it from the paper folding device, while maintaining the folded condition of the document.

Claims:

1. A pre-mailing hand held paper sheet folding device for the uniform triple folding of at least one standard size paper sheet, comprising:

at least four rectangular adjacent sections made of flat thin rigid material, aligned along their short sides and attached to each other along their elongated sides by means of flexible joints, whereas three folding sections of said adjacent four sections are being of identical size and the length of their short side being equal to one third of a standard paper sheet and a fourth holding section being about ⅛" narrower than the adjacent third folding section, allowing said fourth holding section to be folded upon said adjacent third folding section, providing means to accommodate and align at least one of the standard size paper sheet inserted between said third folding section and said fourth holding section, along short sides of all folding sections and against the flexible joint between said third folding section and said fourth holding section, thereby allowing said third folding section and fourth holding section to be further folded in a zig zag pattern with the first two folding sections, while in the process causing the formation of two creases and the uniform triple folding of said at least one standard size paper sheet.

2. The device of claim one, wherein the paper sheet folding device comprise a single sheet of thin, high density material flexible joints between the folding sections being creases formed in said sheet of material.

3. The device of claim one, further comprising access notches on top or bottom of every section so that said notches coincide with each other when the paper folding device is fully closed, with said notches being of a sufficient size as to provide means to grab and extract the at least one standard size paper sheet from the inside of the paper folding device after completion of the folding action, thereby removing the paper sheet in the folded state.

4. The device of claim one, further comprising a holding flap attached to the first folding section for grabbing the top portion of at least one of the standard size paper sheet while conducting the folding process.

* * * * *